United States Patent [19]

Katz

[11] Patent Number: 4,964,540

[45] Date of Patent: Oct. 23, 1990

[54] PRESSURIZED FLUID DISPENSER AND METHOD OF MAKING THE SAME

[75] Inventor: Hyman Katz, Somerset, N.J.

[73] Assignee: Exxel Container, Inc., Somerset, N.J.

[21] Appl. No.: 434,488

[22] Filed: Nov. 13, 1989

Related U.S. Application Data

[63] Continuation of Ser. No. 661,583, Oct. 17, 1984, abandoned.

[51] Int. Cl.[5] ..... B65D 35/28

[52] U.S. Cl. ..... 222/95; 222/105; 222/183; 222/386.5; 383/3; 383/112; 383/120

[58] Field of Search ..... 222/212, 386.5, 183, 222/105, 94, 95, 214, 215, 206; 215/1 C; 264/512, 515, 516, 129; 428/181; 383/2, 3, 109, 112, 116, 120, 901, 118, 113

[56] References Cited

U.S. PATENT DOCUMENTS

| | | | |
|---|---|---|---|
| 2,804,995 | 9/1957 | Fee . | |
| 2,816,690 | 12/1957 | Lari . | |
| 2,966,282 | 12/1960 | Geisler . | |
| 3,083,871 | 4/1963 | Jepson . | |
| 3,087,655 | 4/1963 | Scholle . | |
| 3,157,314 | 11/1964 | Nadler . | |
| 3,323,206 | 6/1967 | Clark . | |
| 3,421,661 | 1/1969 | Price | 222/95 X |
| 3,552,604 | 1/1971 | Gordon . | |
| 3,556,186 | 1/1971 | Besthorne | 383/3 |
| 3,580,427 | 5/1971 | Clarke . | |
| 3,672,543 | 6/1972 | Roper et al. . | |
| 3,721,371 | 3/1973 | Dolveck | 222/386.5 |
| 3,727,803 | 4/1973 | Cobb . | |
| 3,731,854 | 5/1973 | Casey | 222/386.5 |
| 3,733,309 | 5/1973 | Wyeth et al. . | |
| 3,738,538 | 6/1973 | Roper et al. . | |
| 3,745,149 | 7/1973 | Serafini et al. . | |
| 3,745,150 | 7/1973 | Corsover . | |
| 3,767,078 | 10/1973 | Gortz et al. . | |
| 3,791,098 | 2/1974 | Webster . | |
| 3,791,557 | 2/1974 | Venus, Jr. . | |
| 3,796,356 | 3/1974 | Venus, Jr. . | |

(List continued on next page.)

FOREIGN PATENT DOCUMENTS

| | | | |
|---|---|---|---|
| 7631274 | 12/1973 | Australia . | |
| 7837175 | 8/1976 | Australia . | |
| 4031278 | 9/1978 | Australia . | |
| 2304538 | 8/1974 | Fed. Rep. of Germany . | |
| 2442328 | 6/1975 | Fed. Rep. of Germany . | |
| 2704013 | 8/1978 | Fed. Rep. of Germany . | |
| 3815842 | 8/1988 | Japan . | |
| WO/8101143 | 3/1982 | PCT Int'l Appl. . | |
| WO/8200780 | 3/1982 | PCT Int'l Appl. | 222/212 |

OTHER PUBLICATIONS

R. B. Fredickson, et al., "Stretch-Blow Molding For Packaging Versatility," *Plastics Design & Processing*, pp. 22-26 (Nov. 1979).

G. G. Kirschenbaum et al., "Thermo Plastic Polyester PET," Reprinted from *Modern Plastics Enyclopedia*, 1979-1980 McGraw-Hill, Inc. (1979).

Prof. R. B. Seymour, "The Narrowing Field for Plastics for Blow-Molded Beverage Containers," Plastics Design & Processing, pp. 61-65 (Jun. 1977).

D. D. Re, et al., "Here's Why Polyethylene Terephthalate Is The Major Competitor For Beverage Container Applications," (Part 2 PET Processing Methods), *Plastics Design & Processing*, pp. 47-50 (Sep. 1977).

*Primary Examiner*—Andres Kashnikow
*Assistant Examiner*—Gregory L. Huson
*Attorney, Agent, or Firm*—Cooper & Dunham

[57] ABSTRACT

In a dispenser of the kind used for dispensing a fluid by applying pressure on a container, a bag assembly is provided with a tubular pleated bag, a ribbed coating being formed over the bag by dipping. After the bag is selectively discharged causing the bag to collapse, the bag folds along the pleats under the influence of the coating until substantially all of the fluid has been removed. The assembly is made by forming the bag into a pleated shape and then dipping the bag into a suitable material to form a coating with beads. After the coating dries the bag is inserted into the energy tube.

10 Claims, 3 Drawing Sheets

U.S. PATENT DOCUMENTS

| | | | |
|---|---|---|---|
| 3,803,275 | 4/1974 | Corsover . | |
| 3,876,115 | 4/1975 | Venus, Jr. et al. | 222/183 |
| 3,907,169 | 9/1975 | Gortz et al. . | |
| 3,940,026 | 2/1976 | Kain . | |
| 3,946,905 | 3/1976 | Cogliano . | |
| 3,961,725 | 6/1976 | Clark . | |
| 3,981,415 | 9/1976 | Fowler et al. . | |
| 4,052,866 | 10/1977 | Saunders . | |
| 4,067,499 | 1/1978 | Cohen . | |
| 4,077,543 | 3/1978 | Kulikowski et al. . | |
| 4,098,433 | 7/1978 | Uhlig . | |
| 4,121,731 | 10/1978 | Kain . | |
| 4,203,440 | 5/1980 | Theeuwes . | |
| 4,222,499 | 9/1980 | Lee . | |
| 4,251,032 | 2/1981 | Werding . | |
| 4,387,833 | 6/1983 | Venus, Jr. | 222/105 X |
| 4,423,829 | 1/1984 | Katz | 222/215 X |
| 4,492,313 | 1/1985 | Touzani | 215/1 C |
| 4,626,235 | 12/1986 | Kesselring . | |
| 4,701,120 | 10/1987 | Kesselring . | |

FIG. 2
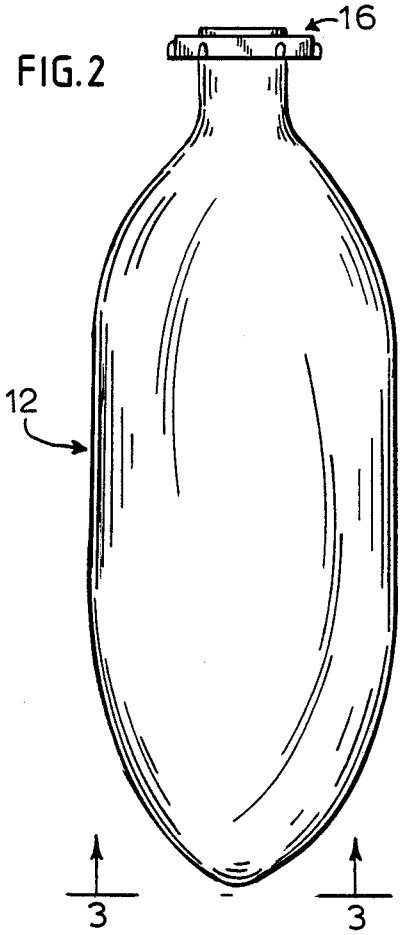
FIG. 4
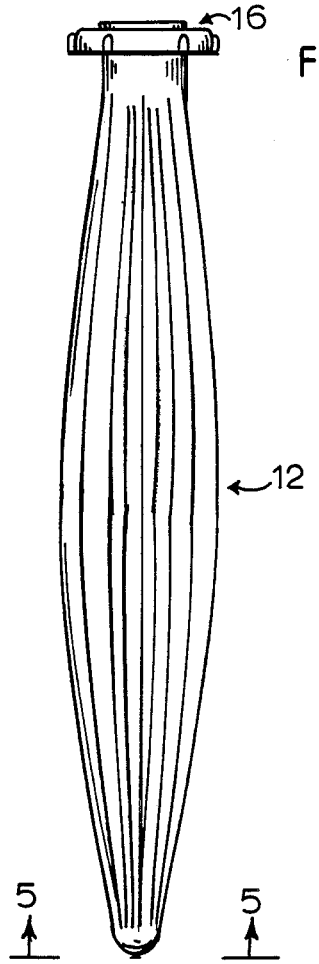
FIG. 3
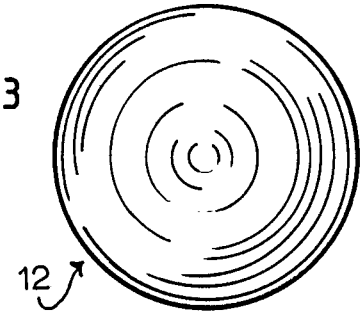
FIG. 5
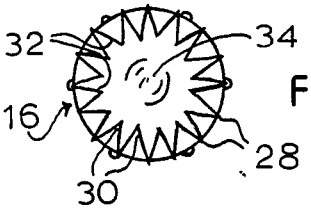
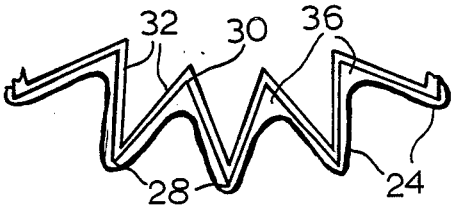
FIG. 6

PRESSURIZED FLUID DISPENSER AND METHOD OF MAKING THE SAME

This is a continuation of application Ser. No. 661,583, filed Oct. 17, 1984, and now abandoned.

FIELD OF INVENTION

This invention relates to a fluid dispenser of the kind which has an outside casing, an inner flexible fluid container and means for applying pressure on the fluid container to expel the fluid through a valve mechanism.

DESCRIPTION OF THE PRIOR ART

Flexible fluid dispensers which are caused to collapse when the fluid is to be expelled have various uses. Recently interest in these types of dispensers has increased because they provide a relatively inexpensive alternative to the aerosol dispensers which make use of a pressurized fluorocarbon gas as a propellant and which have become environmentally unacceptable.

In the most common of prior art containers the walls of the dispenser are manually squeezed to dispense their contents.

In a more complex prior art dispenser, the flexible container is disposed within a rigid casing. Means are provided within the casing to apply continuous pressure on the container walls and the fluid therein. A valve is provided on the mouth of the container which is activated whenever a fluid is to be dispensed. The expelling force is provided by an elastomeric sleeve which surrounds the fluid container.

In order to insure that substantially all the contents of a container are removable, the container must have a shape which makes it possible to collapse the container completely; i.e. with substantially no internal space left. Initially bags were provided which were axially foldable so that in their collapsed state they formed a disc. However the disc still had a relatively large diameter and inherently some residue always remained inside it. An alternate method consisted of using an elongated bag with an open end attached to a dispensing valve, a closed end, and a cylindrical wall therebetween in which pleats are provided so as to divide the walls into sections which can fold in on each other two-by-two. While this arrangement was successful it still shared a basic problem common with all flexible containers, namely that the manner in which the bag folded or collapsed could not be precisely controlled so that often extraneous creases developed which did not permit all the contents of the bag to be dispensed.

In the U.S. Pat. No. 4,387,833 issued June 14, 1983, and incorporated herein by reference, a dispenser is disclosed in which an extra sleeve is provided to keep the energy sleeve from slipping in the axial direction. The sleeve is made of a woven material in such a manner that it can expand and contract radially but not axially. However the sleeve did not control in the manner in which the container folded.

OBJECTIVES AND SUMMARY OF INVENTION

An objective of the present invention is to provide a dispenser with means for collapsing the flexible bag contained therein in a controlled manner until substantially all the fluid disposed within the bag has been expelled.

Another objective is to provide a dispenser which is relatively inexpensive.

A further objective is to provide a method of making said dispenser.

Other objectives and advantages of the invention shall become apparent in the following description of the invention. According to this invention, a fluid dispenser comprises a tubular bag made of a flexible, substantially inexpandable material for containing the fluid to be dispensed, said bag having a mouth adapted to be secured to a valve mechanism, and having a plurality of axial, longitudinal pleats; and a resilient tubular member substantially surrounding said bag and capable of being expanded radially outward as said bag is filled with a pressurized fluid so as to provide sufficient external pressure on said bag to eject said pressurized fluid when said valve mechanism is selectively actuated. The pleated bag is provided with a coating by suitable means such as by dipping into a suitable latex so that a thin, even coating is formed thereon except for the pleat valleys where adjacent walls are bridged by a bead.

BRIEF DESCRIPTION OF THE DRAWINGS

FIG. 2 shows the flexible bag produced by molding;

FIG. 3 shows a bottom view of the bag after molding;

FIG. 4 shows the bag of FIG. 3 after it has been pleated;

FIG. 5 shows a bottom view of FIG. 4;

FIG. 6 shows a partial sectional view of the bag with the coating provided on the bag;

DESCRIPTION OF THE PREFERRED EMBODIMENTS

In the following description any reference to either orientation or direction is intended for the purpose of illustration and is not to be interpreted as a limitation of the invention.

Figure 1:
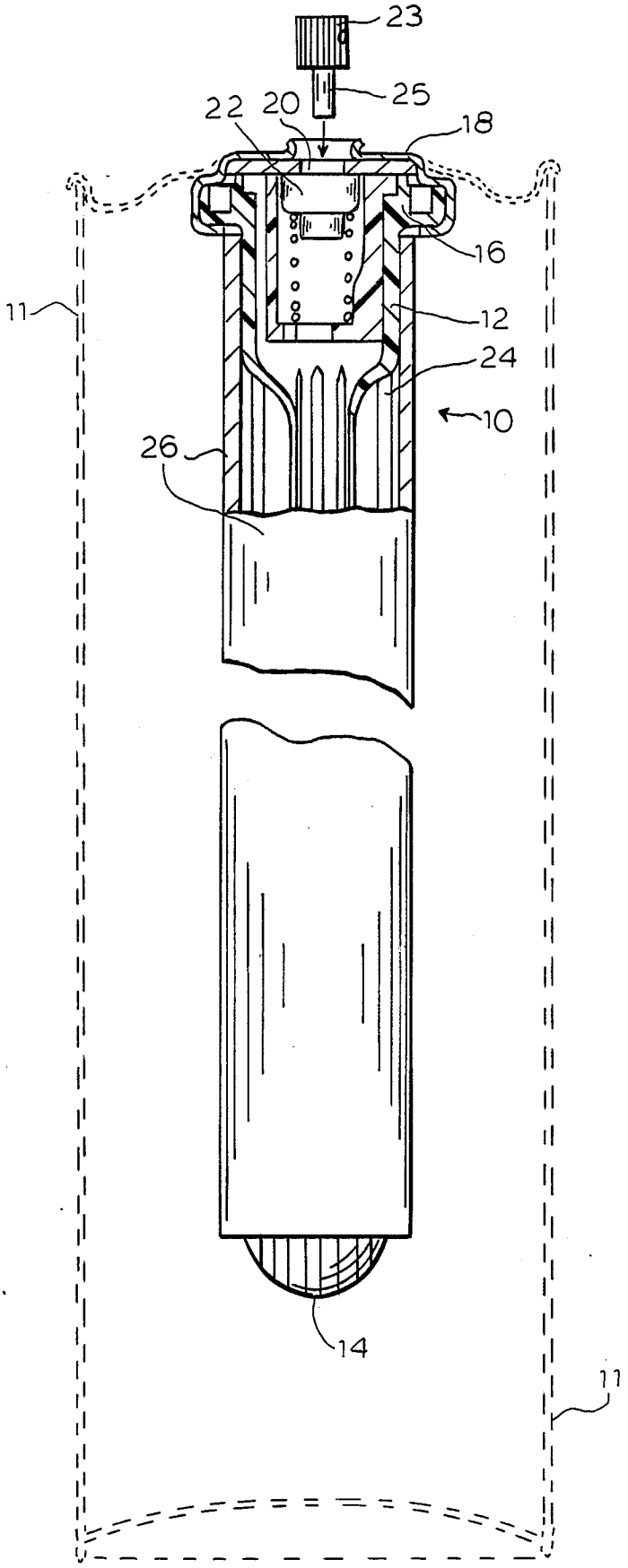
FIG. 1 shows a bag assembly inserted in an enclosure.

A dispenser with a pressurized or barrier bag comprises a bag assembly 10 (see FIG. 1) which is typically inserted in an enclosure 11. The assembly comprises a tubular bag 12 with a closed bottom end 14 and a mouth 16. A metal cap 18 is fitted over the mouth 16. The cap has a central orifice 20 communicating with the interior of the cap. Inside the mouth and concentric therewith is a valve assembly 22 adapted to release pressurized fluid contained within the bag when activated through orifice 20. Such a valve is described in the above-mentioned U.S. Pat. No. 4,387,833. After the bag assembly is inserted in the enclosure 11 an actuator 23 is mounted on top. The actuator has a hollow stem 25 which extends through 20 and releases the fluid when the activator is pressed downward.

The bag is surrounded by a relatively thin and resilient coating 24 which conforms to the shape of the bag. The coating is described more fully below. The coated bag is disposed within an elastomeric member 26 which is commonly described as an energy tube. The member 26 is essentially coextensive with bag 12.

In order to obtain the necessary shape the bag is first formed into the shape of a bottle as shown in FIG. 2.

Preferably the bag is made of a flexible but substantially nonresilient material which is relatively inert so that it will not impart any taste or smell to its contents. For example the bag may be made out of a plastic material such as nylon, polypropylene, polyester or SARANEX. The material may be formed into the shape shown in FIG. 2 by blow molding or similar well-known methods in the art.

Next the bottle shaped bag is pleated into the shape shown in FIGS. 4 and 5. In this form the bag has a plurality of longitudinal or axial pleats defined by crests 28 separated by troughs or valleys 30. Since the bag is flexible it may be compressed radially until the inner walls 32 of each pleat 28 essentially contact or fold over each other. When the bag is compressed or folded in this manner the only empty space left in the bag is a relatively narrow tube 34 defined by troughs 30.

The present inventor has found that the pleated bag can be programmed or constrained to re-fold in a very precise and controlled manner after being filled with a product by enveloping it with a coating applied over the pleats. Preferably a rubber latex coating is applied to the exterior surface of the bag. The latex is chosen so that when it is applied to the bag, it forms a smooth, even, elastic coating on the bag with a bead or rib being generated to fill the bottom of the pleat valleys 30, as shown at 36 on FIG. 6. The size of the bead depends on the density and viscosity of the latex.

Several different rubber-like latex material have been tried and it has been found that pre-vulcanized rubber or a synthetic isoprene are most suitable for the coating.

Latex formulations similar to those used for making different rubber products, such as balloons, surgical gloves, etc. are suitable. Some change in solids content and/or viscosity may be required but these techniques are well known to those in this industry.

The latex is a water based emulsion containing the rubber, filler etc. at room temperature. The bag shaped as shown in FIG. 4 is dipped into the bath and removed. After the excess latex drains off, the coated bags are dipped into a coagulant, drained, then dipped into water for rinsing and then are heated in an oven, at the maximum temperature which will not affect the container, to drive off the water and to form a solid continuous elastic surface coating on the bag. The coating so formed has sufficient adhesion to the bag to withstand further handling.

The bag is now ready for the final assembly. The valve assembly 22 and cap 20 are fitted over mouth 16 of the bag. The elastomeric member 26 is then expanded and pulled over the bag into the position shown in FIG. 1. Preferably the inner diameter of member 26 is smaller than the outer diameter of the coated bag shown in FIG. 4 so that the pleats of the bag are forced close together. During this later operation a vacuum may be applied to the bottle to draw in the pleats thereby making the assembly easier.

As previously described, a fluid is fed under pressure into the bag forcing it to expand substantially into the shape of FIG. 2. Member 26 also expands. The elastomeric member 26 applies sufficient force in the bag to keep it pressurized after it (the bag) has been disconnected from the pressurized fluid source. Thus the fluid may be dispensed by activating the valve assembly 22. As more and more fluid is withdrawn or ejected from the bag, the ribs or beads of the coating disposed in the pleat valleys, force the bag to regain its pleated shape in a smooth, orderly fashion so that extraneous creases are not formed, until the bag is reduced to its minimum or collapsed stage at which point essentially all the fluid contained therein has been removed.

Figure 7:
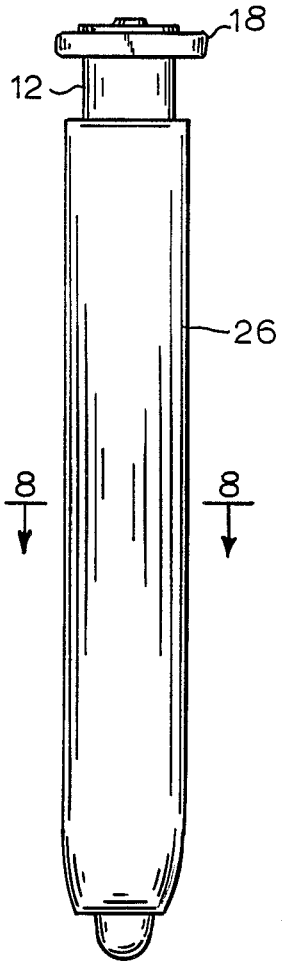
FIG. 7 shows the bag assembly according to this invention.
Figure 10:
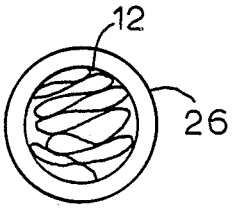
FIG. 10 shows a sectional view taken along line 8—8 of FIG. 7 of a bag assembly without a coating.
Figure 8:
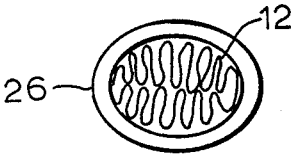
FIG. 8 shows a sectional view taken along line 8—8 of FIG. 7 of a bag assembly with a 1.9 gm coating after the bag has been refolded.
Figure 9:
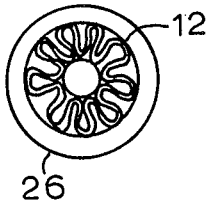
FIG. 9 shows a sectional view taken along line 8—8 of FIG. 7 of a bag assembly with a 5 gm coating.

The effects of an expansion and contraction cycle are illustrated on three different bags. FIG. 8 shows a cross-sectional view of a bag with a 1.9 gm nominal dry weight latex coating taken along lines 8—8 of FIG. 7. FIGS. 9 and 10 show the same view of a bag with a 5 gm nominal dry weight latex coating and no coating respectively. These nominal weights refer to the dry weight of the latex for a nominal 7 fl. oz. container. Smaller and larger containers would have corresponding different weights.

A comparison of FIGS. 8 and 10 shows that the bag without a coating was refolded in a haphazard manner so that in its final stage it still contains many voids and the pleats are not discernible. The bag assembly of FIG. 8 has been deformed into an ellipse but there are less voids than in FIG. 10 and the pleats are readily identifiable. FIG. 9 shows that the bag having a 5 g latex reforms into a configuration with the least number of voids and its pleats are folded evenly.

Thus FIGS. 8–10 show the effectiveness of the invention to control the refolding of the bag. In addition the coating has a relatively non-slip surface so that when the coated bag is disposed within the energy tube sufficient frictional forces develop between the bag and the tube to prevent the tube from slipping axially during its expansion and contraction. In previous configurations such slipping was found to be undesirable because if the tube slips axially some portions of it become more expanded than other portions and therefore during contractions the bags were subjected to uneven pressure. Although slippage could also be prevented by roughing the outer surface of the bag, it has been found that such an operation also introduces undue stress in the structure of the bag thereby weakening it.

Tests have shown that a dispenser built in accordance with this invention functioned properly after being stored on a shelf for a year with a pressurized fluid. Bags constructed in accordance with this invention also functioned properly after being subjected to a temperature of 120° F. for 90 days. These tests conform to the standards functioned properly after being subjected to a temperature of 120° F. for 90 days. These tests conform to the standards accepted by the industry.

It is clear that various modification could be performed on the invention without departing from its scope as defined in the appended claims.

I claim:

1. An apparatus for containing and dispensing a pressurized fluid, comprising:

an expandable bag having a generally cylindrical shaped outer wall, said bag having a closed end and an open end, said outer wall including a plurality of substantially longitudinal pleats, said pleats defining a plurality of peaks and valleys;

valve means coupled with said open end for selectively releasing the contents of the bag;

an expandable energy tube substantially surrounding said bag for maintaining pressure on the bag and its contents;

a plurality of expandable longitudinal ribs disposed in said valleys of said pleats and at least partially filing said valleys, said longitudinal ribs controlling refolding of the pleats in the bag as fluid is released from the bag.

2. An apparatus in accordance with claim 1 wherein said longitudinal pleats extend from adjacent said open end to adjacent said closed end.

3. An apparatus in accordance with claim 1 wherein each said longitudinal rib is latex, prevulcanized natural rubber, or synthetic isoprene.

4. An apparatus in accordance with claim 1 including an enclosure into which said bag is inserted.

5. An apparatus in accordance with claim 1 wherein said plurality of longitudinal ribs is formed by coating said bag such that said coating forms longitudinal ribs filling the bottom of said pleat valleys.

6. An apparatus in accordance with claim 1 wherein an inner diameter of said energy tube is smaller than an outer diameter defined by pleat crests in said bag.

7. An apparatus for containing and dispensing a pressurized fluid, comprising:

an enclosure;

an expandable bag inserted in said enclosure, the bag comprising a generally cylindrically shaped outer wall, said outer wall having a closed end and an open end, said open end defining a mouth through which the fluid may pass, the outer wall of the bag having a plurality of pleats extending from adjacent the mouth to adjacent the closed end such that the bag may be expanded from a contracted pleated position to an expanded position when the fluid is introduced into the bag, said plurality of pleats defining a plurality of peaks and valleys;

a cap secured to said mouth and including a central orifice;

valve means disposed in the central orifice of the cap for selectively releasing said pressurized fluid;

an energy tube for maintaining pressure on the bag and said fluid, said energy tube surrounding the bag and extending longitudinally from adjacent said mouth to adjacent said closed end;

an expandable longitudinal rib disposed in the bottom of each of said valleys and at least partially filling each of said valleys for controlling refolding of the pleats as fluid in said bag is removed.

8. An apparatus in accordance with claim 7 wherein said longitudinal ribs are formed by dipping said bag in latex such that said coating form longitudinal ribs which fills the bottom of each of said pleat valleys.

9. An apparatus in accordance with claim 7 wherein said coating is a latex material.

10. An apparatus in accordance with claim 9 wherein said latex material comprises 5 gram dry weight latex.

* * * * *